US005362164A

United States Patent [19]

Wingert

[11] Patent Number: 5,362,164

[45] Date of Patent: Nov. 8, 1994

[54] GLUE GUN HEAT HOUSING

[75] Inventor: Rudolf Wingert, West Milford, N.J.

[73] Assignee: Electro-Matic Staplers, Inc., Saddle Brook, N.J.

[21] Appl. No.: 125,227

[22] Filed: Sep. 23, 1993

[51] Int. Cl.[5] ..... B05L 17/00; H05B 3/10

[52] U.S. Cl. ..... 401/2; 219/505; 219/540; 219/544

[58] Field of Search ..... 219/230, 505, 540, 544; 222/146.1, 146.5; 401/1, 2

[56] References Cited

U.S. PATENT DOCUMENTS

| | | | |
|---|---|---|---|
| 4,212,425 | 7/1980 | Schlick | 219/505 X |
| 4,814,584 | 3/1989 | Bohlender et al. | 219/505 X |
| 5,194,717 | 3/1993 | Cowen et al. | 219/505 X |

FOREIGN PATENT DOCUMENTS

| | | | |
|---|---|---|---|
| 55157 | 6/1982 | European Pat. Off. | 219/230 |
| 57171 | 8/1982 | European Pat. Off. | 219/540 |
| 76735 | 4/1983 | European Pat. Off. | 219/230 |

*Primary Examiner*—Danton D. DeMille
*Attorney, Agent, or Firm*—Fitzpatrick, Cella, Harper & Scinto

[57] ABSTRACT

A device for heating a substantially solid glue stick or the like includes a heating chamber housing having a heating chamber formed therein and a separate elongated passage including a first open end for receiving a substantially solid glue stick, and a second opposed open end defining an exit opening for melted glue. The heating chamber has an open side and a positive temperature coefficient resistant cartridge positioned in the chamber for heating the housing adjacent to the passage to a temperature sufficient to soften a glue stick therein. A cam structure is located in the chamber engaged with the cartridge adjacent the open side of the chamber and a spring is mounted on the housing in engagement with the cam structure for urging the cam into engagement with the cartridge thereby to accommodate expansion and contraction of the cartridge during operation of the device.

11 Claims, 3 Drawing Sheets

GLUE GUN HEAT HOUSING

FIELD OF THE INVENTION

The present invention relates to devices for heating and melting a piece of rod-shaped thermo plastic material such as, for example, glue, and discharging the melted material for use as an adhesive. In particular, the present invention relates to a heating device for use in a glue gun having an improved positive temperature coefficient resistance cartridge and a mounting arrangement therefor.

BACKGROUND OF THE INVENTION

Manually operated glue guns typically include a tube-shaped heating chamber for receiving a glue stick at its rear end and a nozzle on its front end for discharging melted material. As the solidified glue stick is advanced into the heating chamber the portion of the glue stick which is in the heating chamber is heated to beyond its melting point and the remainder of the still solid glue stick acts as a piston to push the melted glue out of the nozzle and onto the workpiece. The heating apparatus for such devices have previously used a resistor and associated thermostat. Such prior art devices required a relative long time for preheating so that the predetermined operating temperatures would be reached along the channel containing the glue stick. Such prior art devices have not been entirely satisfactory in use and substantial variation occurred in the quality of the joints achieved with the glue.

As a result, it has been proposed to use electrical heating apparatus which include a positive temperature coefficient ("PTC") heating resistor arranged in an axial direction relative to the channel in which the glue stick is introduced.

As is well known, and described for example in U.S. Pat. No. 4,493,972, the use of PTC heating resistors has the advantage of requiring very little power during preheating and during standby. In addition, use of such resistors increase the uniformity of the viscosity of the binding material and allows the thermostat switch of prior art devices to be dispensed with. Typically, conventional PTC resistor cartridges used in glue guns consist of a central resistant element or elements engaged on opposite sides by pressure bodies. The cartridge assembly is held together in various ways, typically for example by an elastic coating as disclosed in U.S. Pat. No. 4,493,972.

PCT resistance cartridges of the prior art are somewhat difficult to assemble. In addition, because the cartridges heat and cool repeatedly, there is substantial expansion and contraction within the housing of the glue gun. However, it is important in order to maintain uniformity of the heat applied to the housing for the cartridge to remain in continuous contact with the housing and previously proposed PTC cartridges could not achieve this desirable result because of their expansion and contraction. Thus uniform heating of the housing is not always accomplished.

OBJECTS OF THE INVENTION

It is an object of the present invention to provide an improved device for heating glue sticks and the like.

Another object of the present invention is to provide a device for heating heat softenable glue sticks and the like which is relatively simple and inexpensive to manufacture.

Yet another object of the present invention is to provide an improved glue stick heating mechanism.

SUMMARY OF THE INVENTION

In accordance with an aspect of the present invention a device for heating a substantially solid heat softenable glue stick is provided which includes a heating chamber housing having a heating chamber formed therein and a separate elongated glue stick passage located parallel to the chamber. The glue stick passage includes a first open end for receiving a substantially solid glue stick and a second opposed open end defining an exit opening for melted glue. The heating chamber has an open side located generally parallel to the passage and a positive temperature coefficient resistant cartridge is positioned in the chamber for heating the housing adjacent to the passage to a temperature sufficient to soften a glue stick therein. The cartridge is generally circular in cross section and includes a least one PTC resistor and at least two pressure bodies located on opposite sides of the PTC resistor. The chamber has a generally semicircular wall portion formed therein adjacent to and spaced from the glue stick passage which is generally complimentary to the circular periphery of the cartridge. The chamber also has at least a pair of sidewalls extending from the semi-circular wall portion thereof to an opening in the housing which defines one side of the chamber. A cam arrangement is located within the chamber, has at least one surface engaged with the cartridge and is generally complimentary in shape to the cartridge. Another surface of the cam is engaged with the sidewalls of the chamber and is movable with respect thereto. A spring is mounted on the housing and is engaged with the cam for urging the cam into engagement with the cartridge to accommodate expansion and contraction thereof while holding the cartridge in contact with the chamber walls.

The above and other objects, features and advantages of the present invention will be apparent in the following detailed description of an illustrative embodiment thereof, which is to be read in conjunction with the accompanying drawings, wherein:

Figure 1:
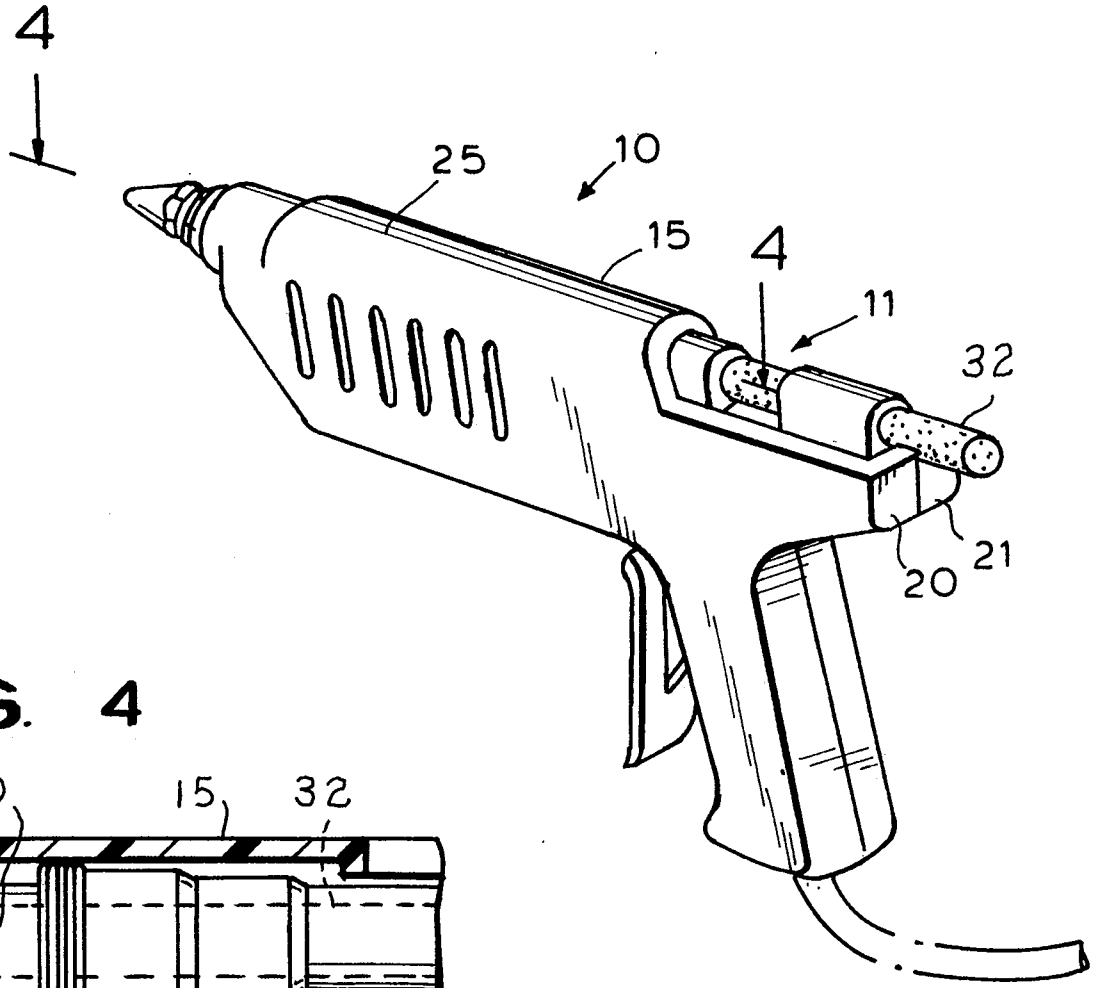
FIG. 1 is a perspective view of a glue gun containing a heating apparatus in accordance with the present invention.
Figure 4:
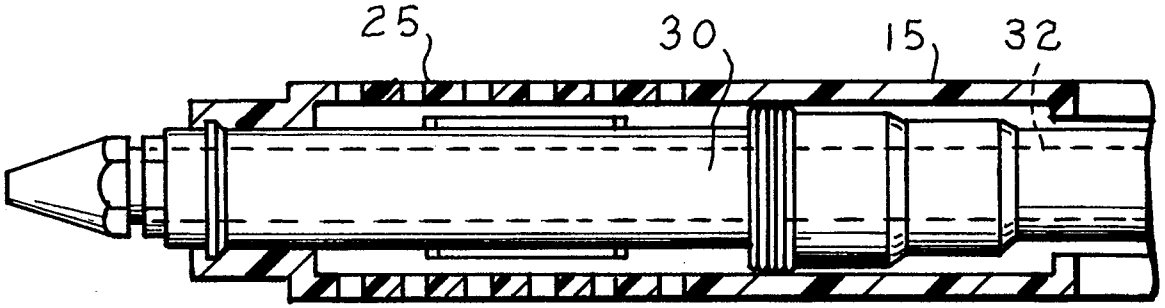
FIG. 4 is a partial sectional taken along line 4—4 of FIG. 1.
Figure 2:
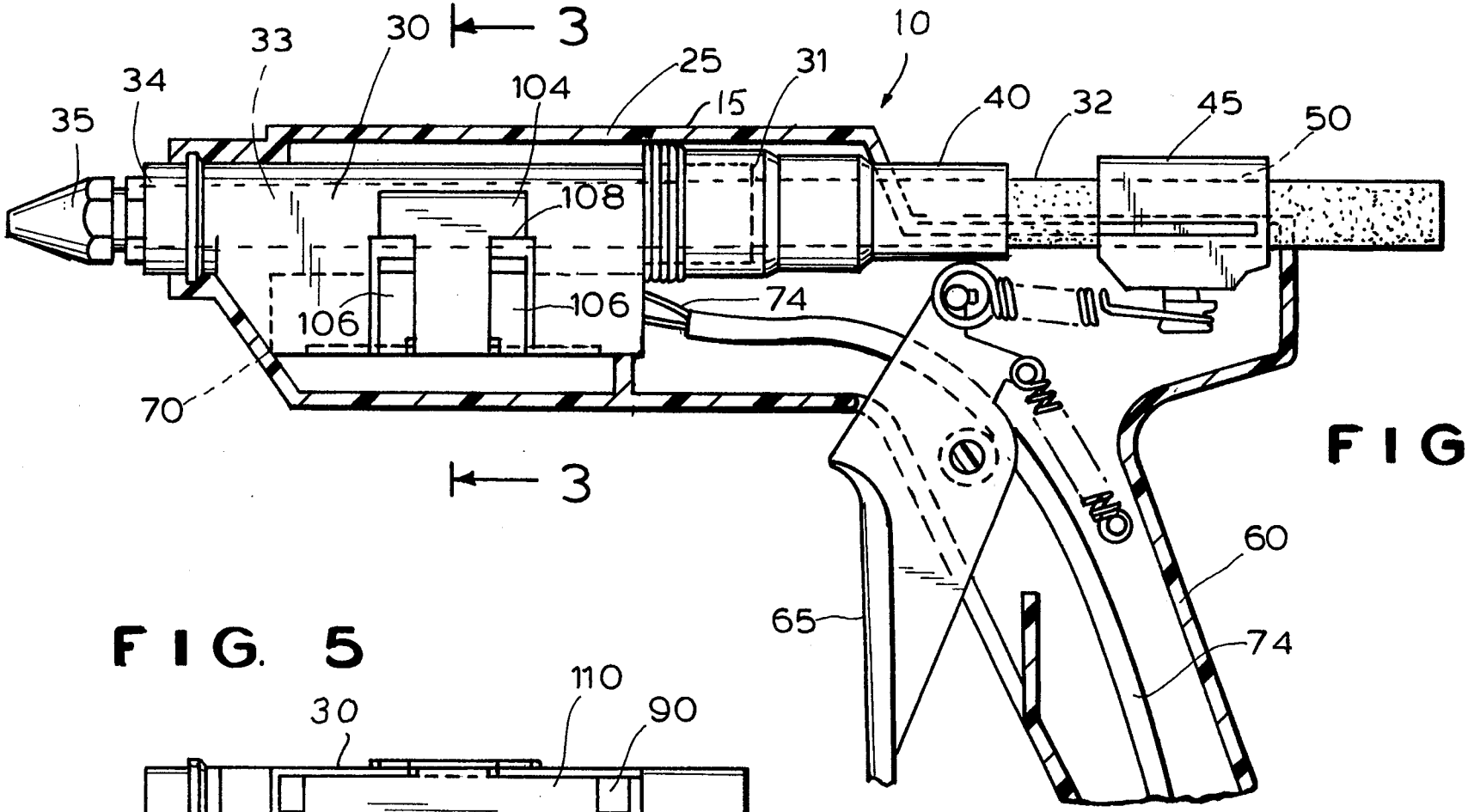
FIG. 2 is a side elevational view, in section, of the glue gun shown in FIG. 1.

Referring now to the drawings in detail, and initially to FIGS. 1 and 2 thereof, a glue gun 10, constructed in accordance with the present invention is illustrated which includes a housing 15 constructed of two medially split sides 20, 21, preferably molded of plastic. The housing 15 includes a front portion 25 in which a heating chamber housing 30 is located. A nozzle 35 is connected to the heating chamber housing 30 in a conventional manner and allows glue which is melted in housing 30 to be discharged or ejected onto a workpiece.

Figure 3:
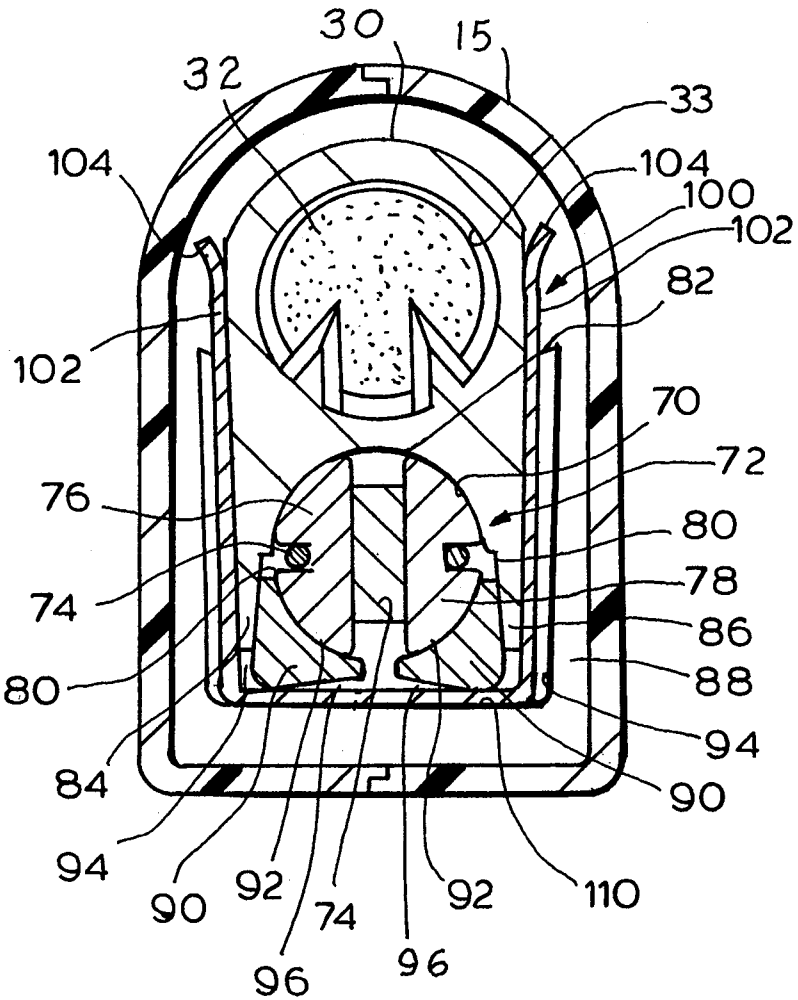
FIG. 3 is a sectional view taken along line 3—3 of FIG. 2.

Heating chamber 30 has a longitudinally extending opening or passage 33 formed therein shown in dotted lines in FIG. 2 and seen in cross section in FIG. 3. The rear end of passage 33 defines an entrance 31 for the substantially solid glue stick 32. The front end of the passage defines an exit 34 from which melted glue is ejected to the nozzle 35. A tubular seal 40, preferably of rubber-like material is attached to the entrance 31 of the heating chat%her 30 to minimize leakage of melted glue.

A longitudinally slidable carriage member 45 is slidably mounted in housing 15 behind seal 40. This carriage has a longitudinal opening 50 extending through it, through which the glue stick 32 passes. The upper rear portion 11 of the gun is preferably open so that the user can readily discern if glue is leaking passed the seal 40 at the entrance to the heating chamber and so that the movement of the slidable carriage can be observed.

The glue gun of the invention is manually operated and includes a handgrip 60 and a lever or trigger 65 operable to advance the glue stick 32. This advance mechanism is described in greater in U.S. Pat. No. 4,776,490 and need not be described here in detail. Any other suitable advance mechanism can also be used.

Referring now to FIGS. 2–5, heating chamber housing 30 has a heating chamber 70 formed therein which is located below and parallel to passage 33. This chamber receives a PTC 72 as described hereinafter which becomes heated by electrical current supplied from the wires 74. The latter are connected through a plug to a conventional source of electricity such as a wall outlet. Heating of the cartridge 72 heats aluminum housing 30 and causes the glue stick in passage 33 above the heating element to soften or melt.

PTC cartridge 72 includes a conventional central resistance element 74 and a pair of elongated pressure plates 76, 78 located on opposite sides thereof. These pressure bars each have a generally semicircular external peripheral configuration and include longitudinally extending slots 80 formed therein which contain the electrical wires for supplying current to the resistance element.

Heating chamber 70 has a cross sectional configuration as seen in FIG. 3 which includes a first arcuate section 82 that is generally complimentary to the arcuate configuration of the pressure plates 76, 78. The chamber further includes a pair of relatively straight side portions 84, 86 which lead to an opening 88 formed in the base of the housing.

In order to uniformly distribute heat to housing 30, pressure plates 76, 78 must be maintained in close contact with the surface 82. This is accomplished by a pair of cams or wedges 90 provided in the heating chamber. These wedges are elongated elements whose length dimension is substantially equal to that of the pressure plates 76, 78. Each wedge is generally triangular in cross section, having an arcuate base 92 which is concave and generally complimentary to the peripheral configuration of the pressure plates. The wedges also include first legs 94 which are positioned to engage the adjacent side walls 84, 86 and to slide relative thereto. The third leg 96 of wedges 90 generally span opening 88 of housing 30.

The entire assembly of PTC cartridge and wedges is maintained in position within chamber 70 by a generally U-shaped spring clip 100. This spring clip has a pair of side legs 102 whose free end 104 terminate in a crosspiece or T structure, as seen in FIG. 1. The legs themselves extend between a pair of embossments 106 formed on the side of the housing which prevent lateral shifting of the U-shaped spring. The inner sides 108 of the crosspiece 104 rests on top of the embossments and resists inadvertent removal of the spring from the housing.

Figure 5:
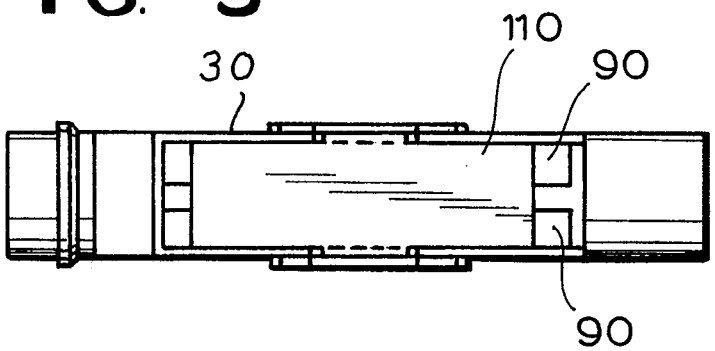
FIG. 5 is a bottom view of the heating element show in FIG. 2.

The bight portion 110 of spring 100 spans opening 88 in the housing and engages legs 96 of the cams or wedges 90. Bight portion 110 is elongated, as seen in FIG. 5, so that it spans substantially the entire length of wedges 90 and to support them within the housing.

As a result of this construction, the assembly of cartridges and wedges is maintained in intimate contact with the walls of the heating chamber, so that heat is uniformly distributed to housing 30. However, expansion and contraction of the PTC cartridge in all directions is accommodated by the spring while maintaining the desired uniform contact. This achieves a more uniform heating and melting of the glue stick in the housing.

Figure 7:
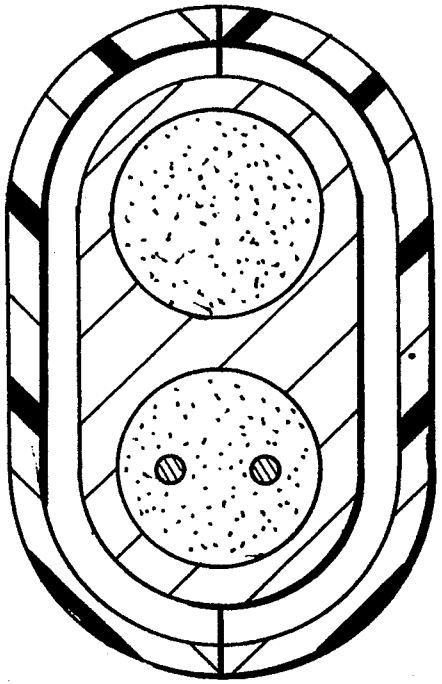
FIG. 7 is a sectional view similar to FIG. 3 of another form of prior art heating element.
Figure 6:
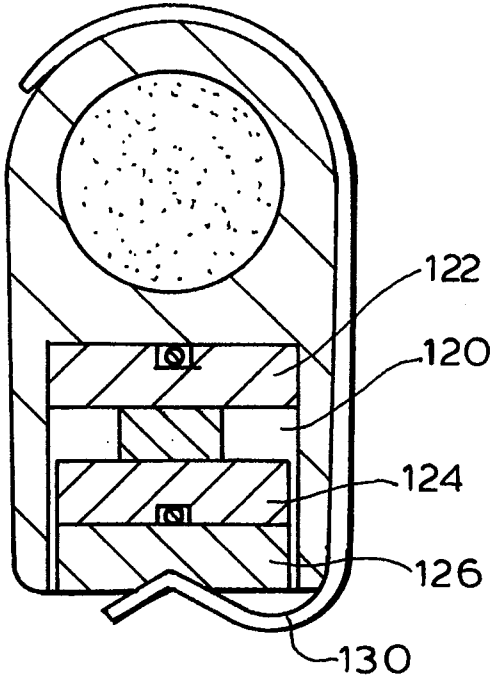
FIG. 6 is a sectional view similar to FIG. 3 of a prior art heating element.

FIGS. 6 and 7 illustrate prior art heating arrangements. FIGS. 7 discloses an arrangement such as shown in FIG. 2 of U.S. Pat. No. 4,493,972. As seen therein the PTC cartridge is simply contained within a generally circular chamber. As will be appreciated, the cartridge must be smaller in diameter than the chamber in order to be installed. Therefore, it will not be in intimate with the housing at all times.

In another prior art embodiment shown in FIG. 6, a PTC cartridge 120 is provided which is generally square in cross section having pressure plates 122 on opposite sides of resistance element 124. A further pressure plate 126 is located below the cartridge and held against the cartridge by C-spring 128 to keep the elements assembled. As will be appreciated, this arrangement will accommodate expansion and contraction only in a direction perpendicular to the length of the resistor element, i.e. in the direction of the apex of the contact leg 130 of the spring. Lateral resistance and expansion and or contraction in any other direction will not be accommodated by the spring.

Accordingly it will be appreciated that the construction of the present invention permits a wide range of latitude of expansion and contraction of the PTC cartridge in the housing in order to maintain uniform heating characteristics.

Although an illustrative embodiment of the invention has been described herein with reference to the accompanying drawings, it is to be understood that the invention is not limited to that precise embodiment, but that various changes and modifications may be effected therein by those skilled in the art without departing from the scope or spirit of this invention.

What is claimed is:

1. A device for heating a substantially solid heat softenable glue stick comprising, a heating chamber housing having a heating chamber formed therein and a separate elongated passage including a first open end for receiving a substantially solid glue stick and a second opposed open end defining an exit opening for melted glue, said heating chamber being generally U-shaped and having an open side defined between a pair of integral side walls formed in the housing; a positive temperature coefficient resistance cartridge means positioned within said heating chamber between said side walls for heating the housing adjacent said passage to a temperature sufficient to soften a glue stick therein, cam means in said chamber between said side walls engaged with said cartridge adjacent the open side of the chamber, and separate spring means formed independently of said cam means mounted on said housing and engaged with said cam means for urging the cam means into engagement with the cartridge to accommodate expansion and contraction thereof; said cartridge, said side walls of the heating chamber, said spring means and said cam means all having cooperating surfaces which allow relative movement of the cam means with respect to the cartridge and housing in a plurality of directions to accommodate expansion and contraction of the cartridge.

2. A device for heating a substantially solid heat softenable glue stick comprising, a heating chamber housing having a heating chamber formed therein and a separate elongated passage including a first open end for receiving a substantially solid glue stick and a second opposed open end defining an exit opening for melted glue, said heating chamber having an open side; a positive temperature coefficient resistance cartridge means positioned in said chamber for heating the housing adjacent said passage to a temperature sufficient to soften a glue stick therein, cam means in said chamber engaged with said cartridge adjacent the open side of the chamber, and spring means mounted on said housing and engaged with said cam means for using the cam means into engagement with the cartridge to accommodate expansion and contraction thereof; said chamber and cam means having cooperating surfaces which allow relative movement of the cam means with respect to the cartridge and housing in a plurality of directions to accommodate expansion and contraction of the cartridge; said cam means comprising a pair of generally triangularly shaped wedges each having a base complimentary to the peripheral configuration of the cartridge and engaged therewith.

3. A device as defined in claim 2 wherein said wedges each have a first leg lying in substantially the same plane across the open side of the chamber and said spring means being engaged with said first legs.

4. A device as defined in claim 3 wherein said spring is generally U shaped having a pair of legs and a bight portion, said spring legs being resiliently engaged with said housing on opposite sides thereof and said bight portion engaging said first legs of said wedges.

5. A device as defined in claim 4 wherein said cartridge is generally circular in cross section and the bases of said wedges have a generally complimentary concave curvature.

6. A device as defined in claim 5 wherein said bight portion of the spring has elongated extensions formed thereon extending in the direction of said passage and engaging said wedges along substantially the length thereof.

7. A device for heating a substantially solid heat softenable glue stick comprising, a heating chamber housing having a heating chamber formed therein and a separate elongated passage located parallel to said chamber and including a first open end for receiving a substantially solid glue stick and a second opposed open end defining an exit opening for melted glue, said heating chamber having an open side located generally parallel to said passage, a positive temperature coefficient resistance cartridge means positioned in said chamber for heating the housing adjacent said passage to a temperature sufficient to soften a glue stick therein; said cartridge being generally circular in cross section and including at least one PTC resistor and at least two pressure bodies located on opposite sides of said at least one PTC resistor, said chamber having a generally arcuate semi-circular wall portion formed therein adjacent to but spaced from said passage which is generally complementary to the circular periphery of the cartridge and at least a pair of side walls extending therefrom leading to an opening in the housing which defines one side of the chamber; cam means in said chamber having at least one surface engaged with said cartridge and being complementary in shape thereto and two additional surfaces engaged with said side walls of the chamber and movable with respect thereto; and spring means mounted on said housing and engaged with said cam means for urging the cam means into engagement with the cartridge to accommodate expansion and contraction thereof.

8. A device as defined in claim 7 wherein said cam means comprises a pair of generally triangularly shaped wedges each having a base complimentary to the peripheral configuration of the cartridge and engaged therewith.

9. A device as defined in claim 8 wherein said wedges each have a first leg lying in substantially the same plane across the open side of the chamber and said spring means being engaged with said first legs.

10. A device as defined in claim 9 wherein said spring is generally U shaped having a pair of legs and a bight portion, said spring legs being resiliently engaged with said housing on opposite sides thereof and said bight portion engaging said first legs of said wedges.

11. A device as defined in claim 6 wherein said bight portion of the spring has elongated extensions formed thereon extending in the direction of said passage and engaging said wedges along substantially the length thereof.

* * * * *